US005890448A

United States Patent [19]

Berresford

[11] Patent Number: 5,890,448

[45] Date of Patent: Apr. 6, 1999

[54] BOAT HULL PROTECTOR

[76] Inventor: Lon E. Berresford, 595 Alice St., East Palestine, Ohio 44413

[21] Appl. No.: 42,093

[22] Filed: Mar. 13, 1998

Related U.S. Application Data

[60] Provisional application No. 60/043,083, Apr. 8, 1997.

[51] Int. Cl.[6] ..... B63B 59/02

[52] U.S. Cl. ..... 114/219; 114/361

[58] Field of Search ..... 114/219, 343, 114/361

[56] References Cited

U.S. PATENT DOCUMENTS

| | | | |
|---|---|---|---|
| 3,055,022 | 9/1962 | Vallquist | 114/343 |
| 4,751,891 | 6/1988 | Wilson | 114/219 |
| 4,815,412 | 3/1989 | Cassaro, Jr. | 114/343 |
| 4,962,719 | 10/1990 | Hughes et al. | 114/361 |
| 5,033,401 | 7/1991 | Bartlett | 114/343 |
| 5,291,848 | 3/1994 | Wilhelm et al. | 114/361 |
| 5,357,890 | 10/1994 | Mason, Jr. et al. | 114/343 |

*Primary Examiner*—Jesus D. Sotelo
*Attorney, Agent, or Firm*—Richard C. Litman

[57] ABSTRACT

A boat hull protector for protecting the surface of the hull and keel of a boat from nicks and scratches in a beaching situation. The boat hull protector incorporates a single positioning and securing means for properly positioning the invention under the boat's hull, and additionally for securing the invention to the boat once positioned. The improvement abolishes the need to incorporate additional positioning components such as floats and drags, separate from the securing components.

4 Claims, 2 Drawing Sheets

BOAT HULL PROTECTOR

CROSS-REFERENCE TO RELATED APPLICATION

This application claims the benefit of U.S. Provisional Patent Application Ser. No. 60/043,083, filed Apr. 8, 1997.

BACKGROUND OF THE INVENTION

1. Field of the Invention

The present invention relates to a marine craft accessory, and more particularly relates to a boating accessory of the type having primary utility as hull protector, also called a beaching apron.

2. Description of Related Art

Many situations exist where boat owners must beach their boats on a gravel, sand, mud, or rocky shoreline. This is particularly common, for instance, where docks are not readily available, as when the boat is beached in an uninhabited area of a river or lake for picnicking, camping, and trailering, as well as in many fishing environments and the like. When beached, the keel or hull of a boat, particularly in the commonly V-shaped bow area, can easily be damaged from abrasion or impact with the shoreline surface.

Additionally, the hull can be damaged after beaching while the boat is parked. This is so because boats are typically moored by tying off the bow of the boat by using an eyebolt and rope to secure the bow to a permanent object such as a tree, and by securing the stern of the boat by means of an anchor. This method of mooring prevents the stern from swinging around onto the shoreline. However, currents and waves may still cause rocking of the boat relative to the shoreline. Without protection, this back-and-forth rocking movement of the bow relative to a muddy, sandy, or rocky shore causes scratching of the hull's surface, regardless of whether the hull is formed of fiberglass, metal or wood. This type of damage reduces performance of the boat, is costly to repair, and greatly reduces the value of the boat. In view of the foregoing, a significant need exists to be able to protect the keel or hull of a boat in a beaching circumstance.

Various inventions for protecting boat hulls are currently known. Examples include U.S. Pat. No. 3,055,022 issued to Vallquist (Boat Beaching Apron); U.S. Pat. No. 4,815,412 issued to Cassaro (Boat Bow Protector); and, U.S. Pat. No. 5,357,890 issued to Mason (Boat Beaching Apron). These inventions all use ropes to secure the hull protector to the hull. However, these inventions all use additional, special components or features to position the hull protector relative to the hull. Particularly, the Vallquist and Cassaro inventions use floats to keep the hull protector properly positioned. The Vallquist invention additionally utilizes drags. The Mason invention does not use floats or drags to position the hull protector but instead uses a body member which is provided with a generally V-shaped groove along its central portion.

The use of additional components or features to position the hull protector relative to the hull is not desirable for various reasons. First, storage space on a boat is extremely limited. Additional components, such as floats and the additional associated ropes for securing the floats to the hull protector take up valuable storage space. Second, additional parts or features make the hull protectors more cumbersome to use. The Mason invention, being formed from solid rubber, cannot be easily manipulated, folded or stowed. The additional ropes and floats associated with the Cassaro device can get tangled and knotted. Third, additional components increase the possibility that one or more of these components will become lost or damaged, thereby making the whole invention useless. Finally, additional positioning components and features increase the cost of the boat hull protectors.

In view of the foregoing, there is a significant need for a boat hull protector which does not need additional positioning components or features. None of the above inventions and patents, taken either singly or in combination, is seen to describe the instant invention as claimed.

SUMMARY OF THE INVENTION

Accordingly, it is a principal object of the invention to provide a device for protecting the bottom of boats to preserve their value.

It is a further object of the present invention to provide a boat hull protector that is particularly suited for protecting a boat in a beaching situation.

It is an additional object of the present invention to provide such a protective device which is capable of easy installation and removal from a boat.

It is a similar object of the present invention to provide such a protective device which is capable of easy storage within a boat.

Still another object of the invention is to provide such a protective device which uses a single means to accomplish both of the required functions of positioning and securing the invention.

A further object of the invention is to provide such a protective device which does not require the inclusion of special, additional positioning components.

It is an object of the invention to provide improved elements and arrangements thereof in an apparatus for the purposes described which is inexpensive, dependable and fully effective in accomplishing its intended purposes.

Accordingly, the present invention is directed to a boat hull protector comprising a durable, flexible, elongated body member, such as a woven fabric sheet. The body member has a predetermined shape configured to wrap about the bow of a boat, comprising a central portion, a forward portion and a pair of opposed side portions. The protector further includes a single means associated with the body member for achieving dual functions: a first function of positioning the body member relative to the keel and hull, and a second function of securing the body member to the boat after it has been suitably positioned relative to the hull.

In the one embodiment, the means for both positioning and securing the body member under the hull comprises grommets disposed on the body member at critical securing points. Positioning of the grommets, which are sized to pass tie-down lines therethrough, at the securing points permits the user to position and secure the invention with the tie-down lines. Use of the device is thus simplified as fewer grommets and lines are employed to secure the boat hull protector to the boat. The shape of a hull determines the critical securing points; namely, the body member must be secured to the boat at a minimum of three positional securing points: one forward point and two opposing rearward points. However, it is preferable that grommets be employed at four positional securing points, including two opposing forward positional securing points, for greater positioning control.

In an alternative and preferred embodiment, the body member is formed in a generally hexagonal shape. One grommet is disposed at each of two forward positional securing points on the forward portion of the body member, and one grommet is disposed at each of two rearward positional securing points on the side portions of the body member. This arrangement allows the body member to better fit the contour of the boat hull. Employing two grommets at the forward portion of the body member advantageously enables the user to run the opposite ends of one tie-line through the two forward grommets, thereby minimizing the number of tie-lines needs and simultaneously maximizing the user's position control.

The aforementioned objects and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
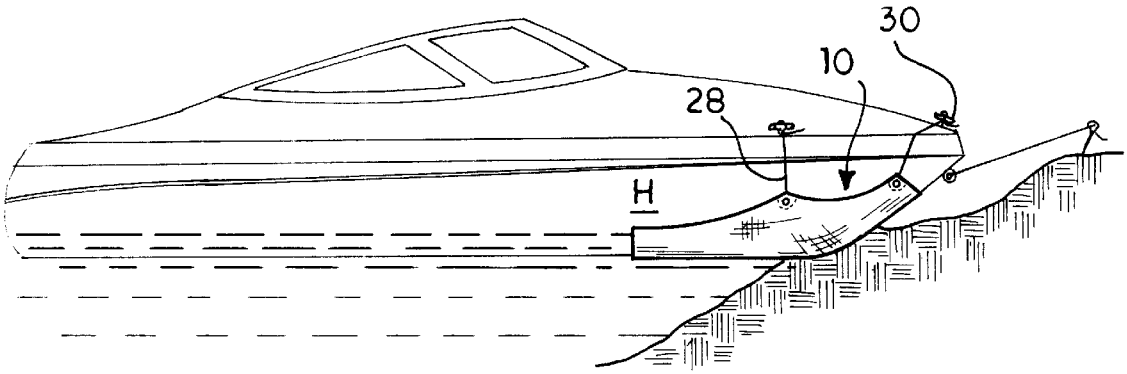
FIG. 1 is an environmental view of a boat hull protector secured to a beached boat according to the present invention.
Figure 2:
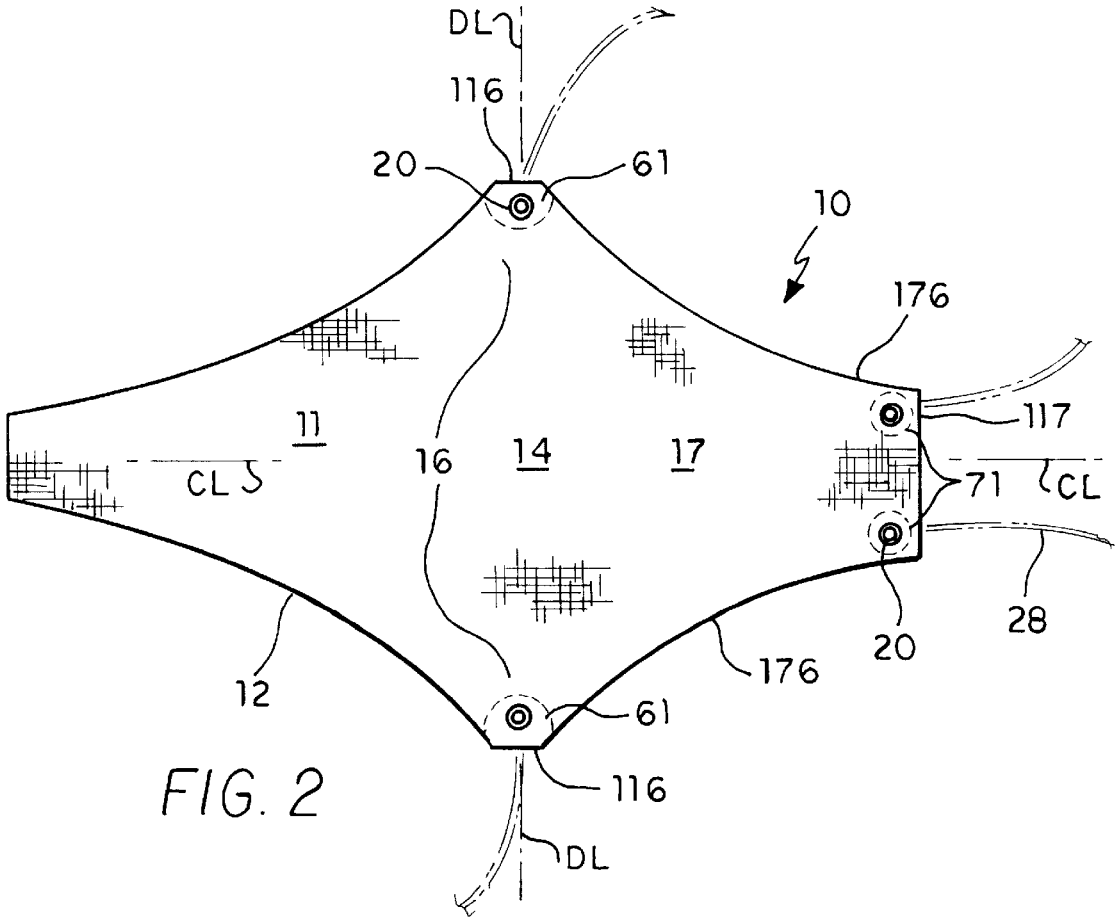
FIG. 2 is a plan view of the boat hull protector as illustrated in FIG. 1.
Figure 3:
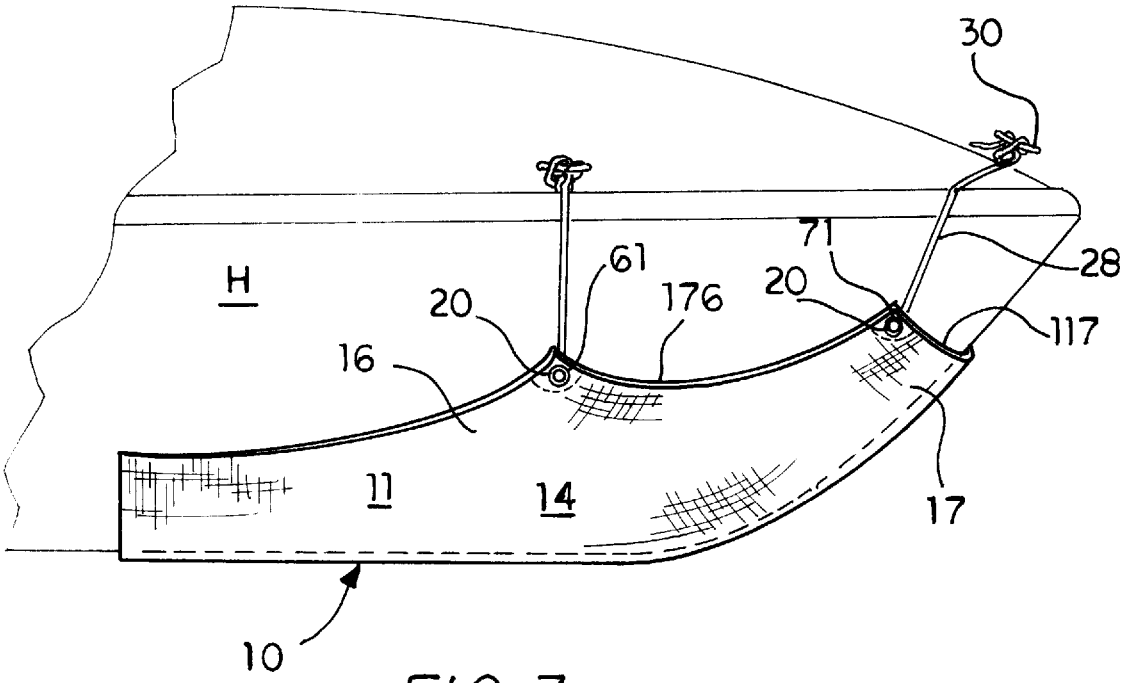
FIG. 3 is a side view of the boat hull protector secured to the boat as illustrated in FIG. 1.
Figure 4:
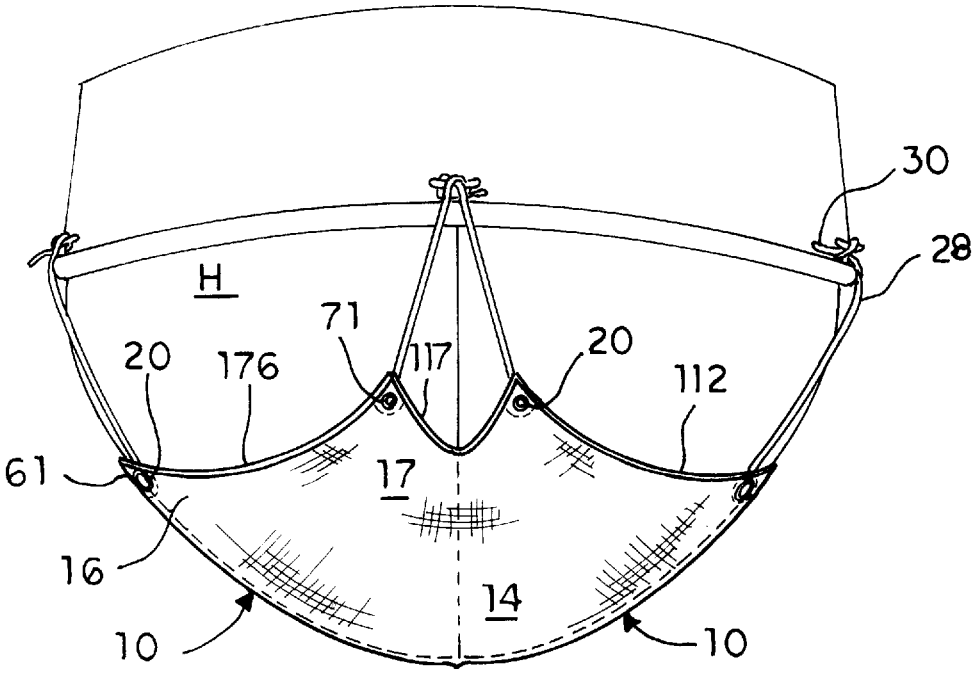
FIG. 4 is a front view of the boat hull protector secured to the boat as illustrated in FIG. 1.

In the illustrations given, and with reference primarily to FIG. 2, the reference numeral 10 designates generally a boat keel/hull protector in accordance with the present invention. It includes a flexible, elongated body member 12 having a rear portion 11, a central portion 14, a pair of opposed side portions 16, and a forward portion 17. The central portion 14 has an overall width substantially greater than the overall width of both the rear portion 11 and forward portion 17. The body member 12 may be a fabric or sheet material having characteristics suitable to accommodate repeated folding and unfolding, as well as, having water and abrasion resistance, such as polyester fabric. Certain woven fabric sheet materials made of water resistant fibers, as are known in the prior art, may be used.

Moreover, the boat hull protector 10 includes a single means associated with the body member 12 for both positioning the body member relative to a hull H and for securing the body member 12 after it has been positioned relative to the hull H. More specifically, the body member 12 is provided with grommets 20, disposed at positional securing points 61 and 71, the grommets 20 being sized for passing tie-down lines 28 therethrough. Tie-down lines 28 are passed through grommets 20 prior to securing the body member 12 to the hull H for later securing the boat hull protector 10 by tie-down line to standard tie-down cleats 30.

The position of the securing points are critical. Forward positional securing points 71 are spaced apart adjacent forward edge 17 located proximate the centerline DL to define a vertical line of symmetry for body member 12 of the body member 12 which parallels the keel of the boat and defines a longitudinal line of symmetry for the body member 12; positional securing points 61 and 61 are located on opposite edges of central portion 14 of the body member 12 along an imaginary dividing line DL which divides the body member 12 approximately in half transverse to the centerline. These points are chosen such that a boater can position the central portion 14 of the body member 12 under the keel. Additional positional securing points are unnecessary to securely fasten the body member 12 to the boat hull because the shape of a bow dictates that the body member 12 must be secured to the boat at a minimum of three positional securing points: one forward positional securing point 71, and two opposing rearward positional securing points 61. However, it is preferable that grommets be employed at four positional securing points, including two opposing forward positional securing points 71 in order to provide for greater positioning control. Additional optional grommet and securing points may also be added.

In one practical embodiment of this principle, the body member 12 is formed in a generally hexagonal shape. The body member has a length of 8 feet extending rearward from the forward edge 117, a width of 16 inches at the forward edge 117, and a maximum width of 5 feet measuring across the side portions which are disposed roughly 3 feet 6 inches rearward of the forward edge. Forward-side edges 176 trail rearward from the leading edge 117 to the side edges 116, in an arcuate path having a radius of approximately 5 feet 6 inches. A pair of 5/16 inch grommets 20 are disposed at opposing forward positional securing points 71 on the forward portion 17 of the body member 12. A second pair of 5/16 inch grommets 20 are disposed at opposing rearward positional securing points 61 on the opposing side portions 16 of the body member 12. A trailing bib is defined by rear portion 11, which requires no securing points and defines approximately half of the body member 12.

These configuration and dimensions allow the body member 12 to best fit the contour of the hull H of many different boats. Of course, the dimensions may be proportionally varied depending on the size of a particular boat. Employing two grommets 20 at the forward portion 71 of the hexagonal body member 12 advantageously enables the user to run the opposite ends of a single tie-line 28 through the two forward grommets 20, thereby minimizing the number of tie-lines needs and simultaneously maximizing the user's position control by using two positional securing points.

It is to be understood that the present invention is not limited to the sole embodiment described above, but encompasses any and all embodiments within the scope of the following claims.

I claim:

1. A boat hull protector for protecting a boat during beaching, comprising:

an elongated body member constructed of a sheet of durable, flexible material, said body member including a rear portion with a rearward edge having a width, a central portion with opposing side edges and a forward portion with a forward edge having a width, said central portion having an overall width substantially greater than the width of said rearward edge and said forward edge;

said body member defining a centerline and a traverse line perpendicular to the centerline, said centerline extending between said forward edge and said rearward edge to define a longitudinal line of symmetry for the body member, said traverse line extending between said opposing side edges of said central portion to define a vertical line of symmetry for the body member;

a first pair of securing means for attaching the forward portion of said body member to the boat, said first pair of securing means being spaced apart adjacent said forward edge proximate the centerline of said body member; and a second pair of securing means for attaching the central portion of said body member to the boat, said second pair of securing means being spaced apart at opposite sides of the central portion along the traverse line of said body member.

2. The boat hull protector according to claim 1, wherein said body member has a generally hexagonal configuration.

3. The boat hull protector according to claim 1, wherein said first pair of securing means and said second pair of securing means includes a pair of grommets, each sized for passing a tie-down line therethrough.

4. The boat hull protector according to claim 1, wherein said body member is constructed from polyester fabric.

* * * * *